US011976860B2

(12) United States Patent
Ranjan et al.

(10) Patent No.: US 11,976,860 B2
(45) Date of Patent: May 7, 2024

(54) ENHANCED REFRIGERATION PURGE SYSTEM

(71) Applicant: Carrier Corporation, Palm Beach Gardens, FL (US)

(72) Inventors: Rajiv Ranjan, South Windsor, CT (US); Parmesh Verma, South Windsor, CT (US); Yinshan Feng, Manchester, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 261 days.

(21) Appl. No.: 15/734,392

(22) PCT Filed: Nov. 27, 2019

(86) PCT No.: PCT/US2019/063657

§ 371 (c)(1),
(2) Date: Dec. 2, 2020

(87) PCT Pub. No.: WO2020/117592

PCT Pub. Date: Jun. 11, 2020

(65) Prior Publication Data

US 2021/0364202 A1 Nov. 25, 2021

Related U.S. Application Data

(60) Provisional application No. 62/774,715, filed on Dec. 3, 2018.

(51) Int. Cl.
*F25B 43/04* (2006.01)
*F25B 43/00* (2006.01)

(52) U.S. Cl.
CPC ..... *F25B 43/043* (2013.01); *F25B 43/003* (2013.01); *F25B 2400/23* (2013.01)

(58) Field of Classification Search
CPC .. F25B 43/043; F25B 43/003; F25B 2400/23; F25B 43/00; F25B 43/04; F25B 49/02
See application file for complete search history.

(56) References Cited

U.S. PATENT DOCUMENTS 2,044,166 A 6/1936 Hayden
4,304,102 A 12/1981 Gray
(Continued)

FOREIGN PATENT DOCUMENTS

CN 1791774 A 6/2006
CN 101254918 A 9/2008
(Continued)

OTHER PUBLICATIONS

International Search Report of the International Searching Authority; International Application No. PCT/US2019/063502; International Filing Date: Nov. 27, 2019; dated Mar. 30, 2020; 8 pages.
(Continued)

*Primary Examiner* — Kun Kai Ma
(74) *Attorney, Agent, or Firm* — CANTOR COLBURN LLP

(57) ABSTRACT

A refrigeration system includes a vapor compression loop and a purge system in communication with the vapor compression loop. The purge system includes at least one separator including a sorbent material to separate contaminants from a refrigerant purge gas provided from the vapor compression loop when the sorbent material is pressurized.

19 Claims, 4 Drawing Sheets

(56) References Cited

U.S. PATENT DOCUMENTS 4,316,364 A 2/1982 Spauschus
4,417,451 A 11/1983 Spauschus
4,842,621 A 6/1989 Robbims et al.
4,906,256 A 3/1990 Baker et al.
4,984,431 A 1/1991 Mount et al.
5,032,148 A 7/1991 Baker et al.
5,044,166 A 9/1991 Wijmans et al.
5,059,374 A 10/1991 Krueger et al.
5,062,273 A 11/1991 Lee et al.
5,071,451 A 12/1991 Wijmans
5,089,033 A 2/1992 Wijmans
5,156,657 A 10/1992 Jain et al.
5,355,685 A 10/1994 Stie et al.
5,429,662 A 7/1995 Fillet
5,505,059 A * 4/1996 Sanborn ..... F25B 17/083 62/480
5,517,825 A * 5/1996 Manz ..... F25B 43/043 62/85
5,598,714 A 2/1997 Strout et al.
5,611,841 A 3/1997 Baker et al.
5,636,526 A 6/1997 Plzak et al.
5,718,119 A 2/1998 Wakita et al.
5,806,322 A 9/1998 Cakmakci et al.
5,842,349 A 12/1998 Wakita et al.
5,858,065 A 1/1999 Li et al.
5,901,780 A * 5/1999 Zeigler ..... F25B 17/083 62/480
6,128,916 A 10/2000 Callahan et al.
6,134,899 A 10/2000 Brown et al.
6,224,763 B1 5/2001 Feng et al.
6,442,963 B1 9/2002 Pfefferle et al.
6,457,326 B1 10/2002 Serpente et al.
6,527,831 B2 3/2003 Baksh et al.
6,705,100 B2 3/2004 Heiden et al.
6,790,350 B2 9/2004 Pex et al.
6,925,821 B2 8/2005 Sienel
7,188,480 B2 3/2007 Korin
7,282,148 B2 10/2007 Dalton et al.
7,357,002 B2 4/2008 Yoshimi et al.
7,387,661 B2 6/2008 Qunwei et al.
7,690,219 B2 4/2010 Suzuki et al.
7,713,333 B2 5/2010 Rege et al.
7,758,670 B2 7/2010 Wynn et al.
7,765,830 B2 8/2010 Zhang
7,891,202 B1 2/2011 Gallus
7,918,921 B2 4/2011 Wynn
8,055,453 B2 11/2011 Wyatt
8,182,592 B2 5/2012 Nakamura et al.
8,216,473 B2 7/2012 Wohlert
8,361,197 B2 1/2013 Kawai et al.
8,394,171 B2 3/2013 Elseviers et al.
8,580,015 B2 11/2013 Taylor et al.
8,652,332 B2 2/2014 Karnik et al.
9,067,169 B2 6/2015 Patel
9,073,808 B1 7/2015 Su et al.
9,175,233 B2 11/2015 Goldstein et al.
9,199,191 B2 12/2015 Fukuda et al.
9,216,373 B2 12/2015 Girondi
9,504,962 B2 11/2016 Yamaoka et al.
9,579,605 B1 2/2017 Su et al.
9,610,534 B1 4/2017 Thompson
9,718,023 B2 8/2017 Kanetsuki et al.
9,987,568 B2 6/2018 Stark et al.
9,989,285 B2 6/2018 Fountain et al.
10,584,906 B2 3/2020 Ranjan et al.
2002/0006369 A1 1/2002 Buxbaum
2002/0148238 A1 10/2002 Blume
2003/0075504 A1 4/2003 Zha et al.
2003/0121840 A1 7/2003 Pex et al.
2006/0011535 A1 1/2006 Ikeda et al.
2006/0254422 A1 11/2006 Spadaccini et al.
2007/0101759 A1 5/2007 Matsuoka et al.
2007/0113581 A1 5/2007 Yoshimi et al.
2007/0193285 A1 8/2007 Knight et al.
2008/0202152 A1 8/2008 Munoz et al.
2008/0202153 A1 8/2008 Watanabe
2008/0217247 A1 9/2008 Niino et al.
2010/0006503 A1 1/2010 Bratton et al.
2011/0120157 A1 5/2011 Wohlert
2012/0000220 A1 1/2012 Altay
2012/0118004 A1 * 5/2012 Minhas ..... F17C 5/06 62/476
2013/0118198 A1 5/2013 Brown et al.
2013/0283830 A1 10/2013 Jandal et al.
2013/0283832 A1 10/2013 Kujak et al.
2013/0283846 A1 * 10/2013 Baumann ..... F25B 17/083 62/476
2015/0053083 A1 2/2015 Taylor
2015/0059368 A1 * 3/2015 Minhas ..... B01J 20/3204 62/79
2015/0323226 A1 11/2015 Haraki et al.
2016/0025393 A1 1/2016 Rockwell
2016/0175740 A1 6/2016 Stark et al.
2017/0014748 A1 1/2017 Li et al.
2017/0122670 A1 5/2017 Ahlbom
2017/0307269 A1 10/2017 Gu et al.
2017/0348643 A1 12/2017 Noguchi et al.
2018/0066880 A1 3/2018 Ranjan et al.
2018/0243685 A1 8/2018 Henson et al.
2020/0149791 A1 * 5/2020 Ranjan ..... F25B 13/00
2021/0229024 A1 7/2021 Ranjan et al.
2021/0231354 A1 7/2021 Ranjan et al.
2021/0356348 A1 * 11/2021 Solomon ..... G01M 3/205
2021/0364203 A1 11/2021 Ranjan et al.

FOREIGN PATENT DOCUMENTS

CN 101373111 A 2/2009
CN 201363956 Y 12/2009
CN 101910756 A 12/2010
CN 201954828 U 8/2011
CN 101852524 B 7/2012
CN 203657302 U 6/2014
CN 104785045 A 7/2015
CN 106895617 A 6/2017
CN 107763910 A 3/2018
CN 108061410 A 5/2018
CN 108344214 A 7/2018
CN 108413665 A 8/2018
CN 108474601 A 8/2018
DE 19908848 A1 7/2000
EP 0284850 B1 10/1988
EP 0875281 A1 11/1998
EP 0943367 A1 9/1999
EP 1650509 A1 4/2006
EP 1681523 A1 7/2006
EP 2312241 A1 4/2011
EP 2481474 A1 8/2012
EP 2815798 A1 12/2014
EP 3085430 A1 10/2016
EP 3118545 A1 1/2017
GB 1112580 A 5/1968
GB 2011796 A 7/1979
GB 2276229 A 9/1994
JP H0552452 A 3/1993
JP H0557125 A 3/1993
JP H07294065 A 11/1995
JP H10213363 A 8/1998
JP 2005127561 A 5/2005
JP 2005127563 A 5/2005
JP 2005127564 A 5/2005
JP 2005127565 A 5/2005
JP 4265369 B2 5/2009
JP 2010159952 A 7/2010
JP 11248298 9/2011
JP 2013039546 A 2/2013
JP 5585307 9/2014
JP 2015182070 A 10/2015
KR 101533348 B1 7/2015
WO 9717125 A1 5/1997
WO 2015020719 A1 2/2015
WO WO-2015091303 A1 * 6/2015 ..... B01D 53/0454
WO 2017184663 A1 10/2017
WO 2018134789 A1 7/2018

(56) References Cited

FOREIGN PATENT DOCUMENTS

OTHER PUBLICATIONS

International Search Report of the International Searching Authority; International Application No. PCT/US2019/063512; International Filing Date: Nov. 27, 2019; dated Feb. 18, 2020; 5 pages.
International Search Report of the International Searching Authority; International Application No. PCT/US2019/063657; International Filing Date: Nov. 27, 2019; dated Feb. 18, 2020; 5 pages.
International Search Report of the International Searching Authority; International Application No. PCT/US2019/064174; International Filing Date: Dec. 3, 2019; dated Feb. 18, 2020; 6 pages.
Written Opinion of the International Searching Authority; International Application No. PCT/US2019/063502; International Filing Date: Nov. 27, 2019; dated Mar. 30, 2020; 10 pages.
Written Opinion of the International Searching Authority; International Application No. PCT/US2019/063512; International Filing Date: Nov. 27, 2019; dated Feb. 18, 2020; 7 pages.
Written Opinion of the International Searching Authority; International Application No. PCT/US2019/063657; International Filing Date: Nov. 27, 2019; dated Feb. 18, 2020; 7 pages.
Written Opinion of the International Searching Authority; International Application No. PCT/US2019/064174; International Filing Date: Dec. 3, 2019; dated Dec. 3, 2018; 7 pages.
Chinese Office Action for Chinese Application No. 201980041006.4; Report dated Feb. 11, 2023 (pp. 1-3).
Chinese Office Action for Chinese Application No. 201980041011.5; Report dated Feb. 24, 2023 (pp. 1-6).
U.S. Non-Final Office Action; U.S. Appl. No. 15/734,842, filed Dec. 3, 2020; dated Apr. 14, 2023; 36 pages.
Chinese First Office Action; Chinese Application No. 201980041006.4; dated Jul. 15, 2022; 14 pages.
Chinese First Office Action; Chinese Application No. 201980041011.5; dated Aug. 5, 2022; 17 pages.
U.S. Final Office Action; U.S. Appl. No. 15/734,844; dated Aug. 8, 2022; 14 pages.
International Preliminary Report on Patentability; International Application No. PCT/US2019/063502; International Filing Date: Nov. 27, 2019; dated Jun. 17, 2021; 10 pages.
International Preliminary Report on Patentability; International Application No. PCT/US2019/063512; International Filing Date: Nov. 27, 2019; dated Jun. 17, 2021; 7 pages.
International Preliminary Report on Patentability; International Application No. PCT/US2019/063657; International Filing Date: Nov. 27, 2019; dated Jun. 17, 2021; 7 pages.
International Preliminary Report on Patentability; International Application No. PCT/US2019/064174; International Filing Date: Dec. 3, 2019; dated Jun. 17, 2021; 7 pages.
"Cascade Reverse Osmosis and the Absorption Osmosis Cycle"; Battelle Memorial Institute; ARPA-E; Retrieved Online from http://arpa-e.energy.gov/?q=slick-sheet-project/cascade-reverse-osmosis-air-conditioning-system on Jul. 12, 2010; 1 Page.
Biruh Shimekit and Hilmi Mihtar (2012). Natural Gas Purification Technologies—Major Advances for CO2 Separation and Future Directions, Advances in Natural Gas Technology, Dr. Hamid Almegren (Ed.)ISBN:978-953-51-0507-7, pp. 235-270, http://cdn.intechopen.com/pdfs/35293/InTech-Natural_gas_purification_technologies_major_advances_for_co2_separation_and_future_directions.pdf.
Chinese Office Action and Search Report from Chinese Application No. 201480044756.4 dated Apr. 28, 2017; 17 Pages.
Chinese Office Action and Search Report from Chinese Application No. 201480044756.4 dated Dec. 14, 2017; 18 Pages.
Coronas et al.; "Separations Using Zeolite Membranes"; Separation and Purification Methods; vol. 28, Issue 2; 1999; 6 Pages.
Daramola et al.; "Potential Applications of Zeolite Membranes in Reaction Coupling Separation Processes"; Materials; vol. 5; 2012; pp. 2101-2136.
Extended European Search Report; International Application No. 18205247.2-1008; International Filing Date: Nov. 8, 2018; dated Mar. 14, 2019; 7 pages.
International Search Report of the International Searching Authority; International Application No. PCT/US2014/040795; International filing date: Jun. 4, 2014; dated Aug. 29, 2014, 4 pages.
Rao et al.; "Nanoporous Carbon Membranes for Separation of Gas Mixtures by Selective Surface Flow"; Journal of Membrane Science; vol. 85, Issue 3; Dec. 2, 1993; pp. 253-264.
U.S. Non-Final Office Action; U.S. Appl. No. 14/909,542, filed Feb. 2, 2016; dated Sep. 21, 2017; 23 pages.
U.S. Non-Final Office Action; U.S. Appl. No. 15/808,837, filed Nov. 9, 2017; dated Jun. 6, 2019; 32 pages.
Written Opinion of the International Searching Authority; International Application No. PCT/US2014/040795; International Filing Date: Jun. 4, 2014; dated Aug. 29, 2014; 4 pages.
Chinese Office Action for Chinese Application No. 201980041015.3; Report dated Dec. 28, 2022 (pp. 1-8).
U.S. Non-Final Office Action; U.S. Appl. No. 15/734,846; dated Mar. 20, 2023; 42 pages.
U.S. Non-Final Office Action; U.S. Appl. No. 15/734,844, filed Dec. 3, 2020; dated Jan. 27, 2022; 34 pages.
Chinese Office Action for Chinese Application No. 201980041015.3; Report dated Sep. 28, 2023 (pp. 1-14—With machine translation).
Chinese Office Action for Chinese Application No. 201980041015.3; Report Mail Date Jan. 15, 2024 (pp. 1-15—With machine translation).

* cited by examiner

ENHANCED REFRIGERATION PURGE SYSTEM

CROSS REFERENCE TO RELATED APPLICATIONS

This application is a National Stage Application of PCT/US2019/063657, filed Nov. 27, 2019, which claims priority to U.S. Provisional Application 62/774,715 filed Dec. 3, 2018, both which are incorporated by reference in their entirety herein.

BACKGROUND

Embodiments of the present disclosure relate generally to chiller systems used in air conditioning systems, and more particularly to a purge system for removing contaminants from a refrigeration system.

Chiller systems such as those utilizing centrifugal compressors may include sections that operate below atmospheric pressure. As a result, leaks in the chiller system may draw air into the system, contaminating the refrigerant. This contamination degrades the performance of the chiller system. To address this problem, existing low pressure chillers include a purge unit to remove contamination. Existing purge units typically use a vapor compression cycle to separate contaminant gas from the refrigerant. Existing purge units are complicated and lose refrigerant in the process of removing contamination.

BRIEF DESCRIPTION

Disclosed is a refrigeration system including a vapor compression loop and a purge system in communication with the vapor compression loop. The purge system includes at least one separator including a sorbent material to separate contaminants from a refrigerant purge gas provided from the vapor compression loop when a driving force is applied to the sorbent material.

In addition to one or more of the features described above, or as an alternative, in further embodiments including a prime mover selectively coupled to the at least one separator to apply a driving force to the sorbent material.

In addition to one or more of the features described above, or as an alternative, in further embodiments the prime mover is a vacuum pump.

In addition to one or more of the features described above, or as an alternative, in further embodiments the at least one separator is arranged in fluid communication with the vapor compression loop.

In addition to one or more of the features described above, or as an alternative, in further embodiments the vapor compression loop includes a compressor, a heat rejection heat exchanger, an expansion device, and a heat absorption heat exchanger connected by a conduit.

In addition to one or more of the features described above, or as an alternative, in further embodiments refrigerant passing through the sorbent material is returned to the at least one of the heat rejection heat exchanger and the heat absorption heat exchanger.

In addition to one or more of the features described above, or as an alternative, in further embodiments the purge system further includes a purge gas collector in communication with the at least one separator and at least one of the heat rejection heat exchanger and the heat absorption heat exchanger.

In addition to one or more of the features described above, or as an alternative, in further embodiments the purge gas collector comprises purge gas therein, the purge gas including refrigerant gas and contaminants.

In addition to one or more of the features described above, or as an alternative, in further embodiments said at least one separator includes a first separator and a second separator arranged in parallel.

In addition to one or more of the features described above, or as an alternative, in further embodiments including a flow control valve arranged upstream from an inlet end of both the first separator and the second separator, the flow control valve being selectively controllable to direct a flow toward one of the first separator and the second separator.

In addition to one or more of the features described above, or as an alternative, in further embodiments including a first valve arranged downstream from an outlet end of the first separator, wherein the first valve is movable between a first position and a second position.

In addition to one or more of the features described above, or as an alternative, in further embodiments when the first valve is in the first position, the prime mover is connected to the first separator and the outlet end of the first separator is in fluid communication with the vapor compression loop.

In addition to one or more of the features described above, or as an alternative, in further embodiments when the first valve is in the second position, the first separator is at ambient pressure, and the sorbent material is regenerated.

In addition to one or more of the features described above, or as an alternative, in further embodiments including a controller operably coupled to the flow control valve and to the prime mover.

In addition to one or more of the features described above, or as an alternative, in further embodiments the controller is operable to transform the flow control valve between a first position and a second position in response to a purge signal.

In addition to one or more of the features described above, or as an alternative, in further embodiments the purge signal is generated in response to an elapse of a predetermined amount of time.

In addition to one or more of the features described above, or as an alternative, in further embodiments the purge signal is generated in response to a measured parameter of the vapor compression system.

In addition to one or more of the features described above, or as an alternative, in further embodiments the sorbent material of the at least one separator is arranged in a bed.

In addition to one or more of the features described above, or as an alternative, in further embodiments the sorbent material of the at least one separator is arranged in a plurality of beds.

In addition to one or more of the features described above, or as an alternative, in further embodiments including a heat source in thermal communication with the sorbent material of the at least one separator.

In addition to one or more of the features described above, or as an alternative, in further embodiments the heat source is operable to generate the driving force applied to the sorbent material.

According to another embodiment, a method of operating a refrigeration system includes circulating a refrigerant through a vapor compression loop including a compressor, a heat rejecting heat exchanger, an expansion device, and a heat absorbing heat exchanger, collecting purge gas comprising contaminants from the vapor compression loop, and providing the purge gas to a separator pressurized by a prime mover to allow passage of refrigerant through a sorbent material and sorption of contaminants within the separator.

In addition to one or more of the features described above, or as an alternative, in further embodiments including collecting the purge gas in a purge gas collector positioned between the vapor compression loop and the separator.

In addition to one or more of the features described above, or as an alternative, in further embodiments including returning refrigerant that has passed through the sorbent material to the vapor compression loop.

In addition to one or more of the features described above, or as an alternative, in further embodiments including adjusting a pressure of the separator to regenerate the sorbent material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
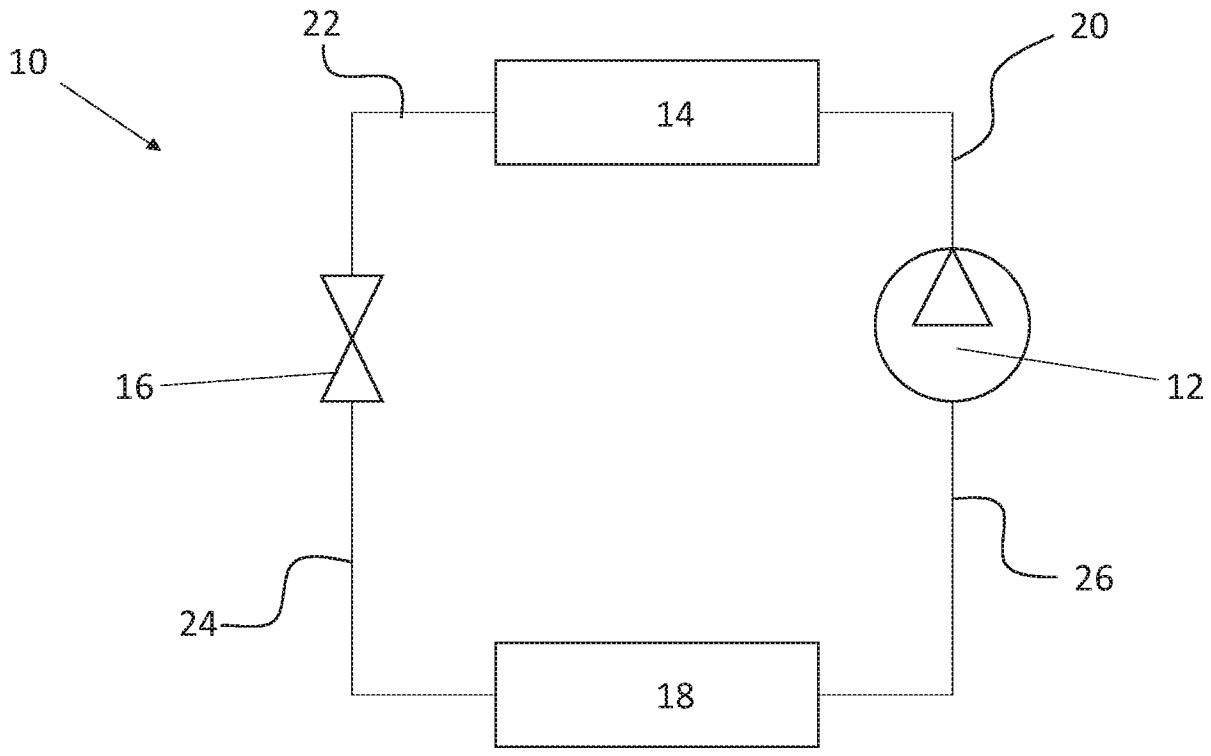
FIG. 1 is a schematic diagram of a vapor compression loop of a refrigerant system.

Referring now to FIG. 1, an example of a vapor compression cycle of a refrigeration system is illustrated. As shown, a vapor compression loop 10 includes a compressor 12, a condenser 14, an expansion valve 16, and an evaporator 18. The compressor 12 pressurizes heat transfer fluid in its gaseous state, which both heats the fluid and provides pressure to circulate it through the system. In some embodiments, the heat transfer fluid, or refrigerant, includes an organic compound. For example, in some embodiments, the refrigerant comprises at least one of a hydrocarbon, substituted hydrocarbon, a halogen-substituted hydrocarbon, a fluoro-substituted hydrocarbon, or a chloro-fluoro-substituted hydrocarbon.

The hot pressurized gaseous heat transfer fluid exiting from the compressor 12 flows through a conduit 20 to a heat rejection heat exchanger such as condenser 14. The condenser is operable to transfer heat from the heat transfer fluid to the surrounding environment, resulting in condensation of the hot gaseous heat transfer fluid to a pressurized moderate temperature liquid. The liquid heat transfer fluid exiting from the condenser 14 flows through conduit 22 to expansion valve 16, where the pressure is reduced. The reduced pressure liquid heat transfer fluid exiting the expansion valve 16 flows through conduit 24 to a heat absorption heat exchanger such as evaporator 18. The evaporator 18 functions to absorb heat from the surrounding environment and boil the heat transfer fluid. Gaseous heat transfer fluid exiting the evaporator 18 flows through conduit 26 to the compressor 12, so that the cycle may be repeated.

The vapor compression loop 10 has the effect of transferring heat from the environment surrounding the evaporator 18 to the environment surrounding the condenser 14. The thermodynamic properties of the heat transfer fluid must allow it to reach a high enough temperature when compressed so that it is greater than the environment surrounding the condenser 14, allowing heat to be transferred to the surrounding environment. The thermodynamic properties of the heat transfer fluid must also have a boiling point at its post-expansion pressure that allows the temperature surrounding the evaporator 18 to provide heat to vaporize the liquid heat transfer fluid.

Various types of refrigerant systems includes a vapor compression loop 10 as illustrated and described herein. One such refrigerant system is a chiller system. Portions of the refrigeration systems, such as the cooler of a chiller system for example, may operate at a low pressure (e.g., less than atmosphere) which can cause contamination (e.g., ambient air) to be drawn into the vapor compression loop 10 of the refrigeration system. The contamination degrades performance of the refrigeration system. To improve operation, the vapor compression loop 10 of a refrigeration system may additionally include a purge system 30 for removing contamination from the heat transfer fluid of the vapor compression loop 10.

Figure 2:
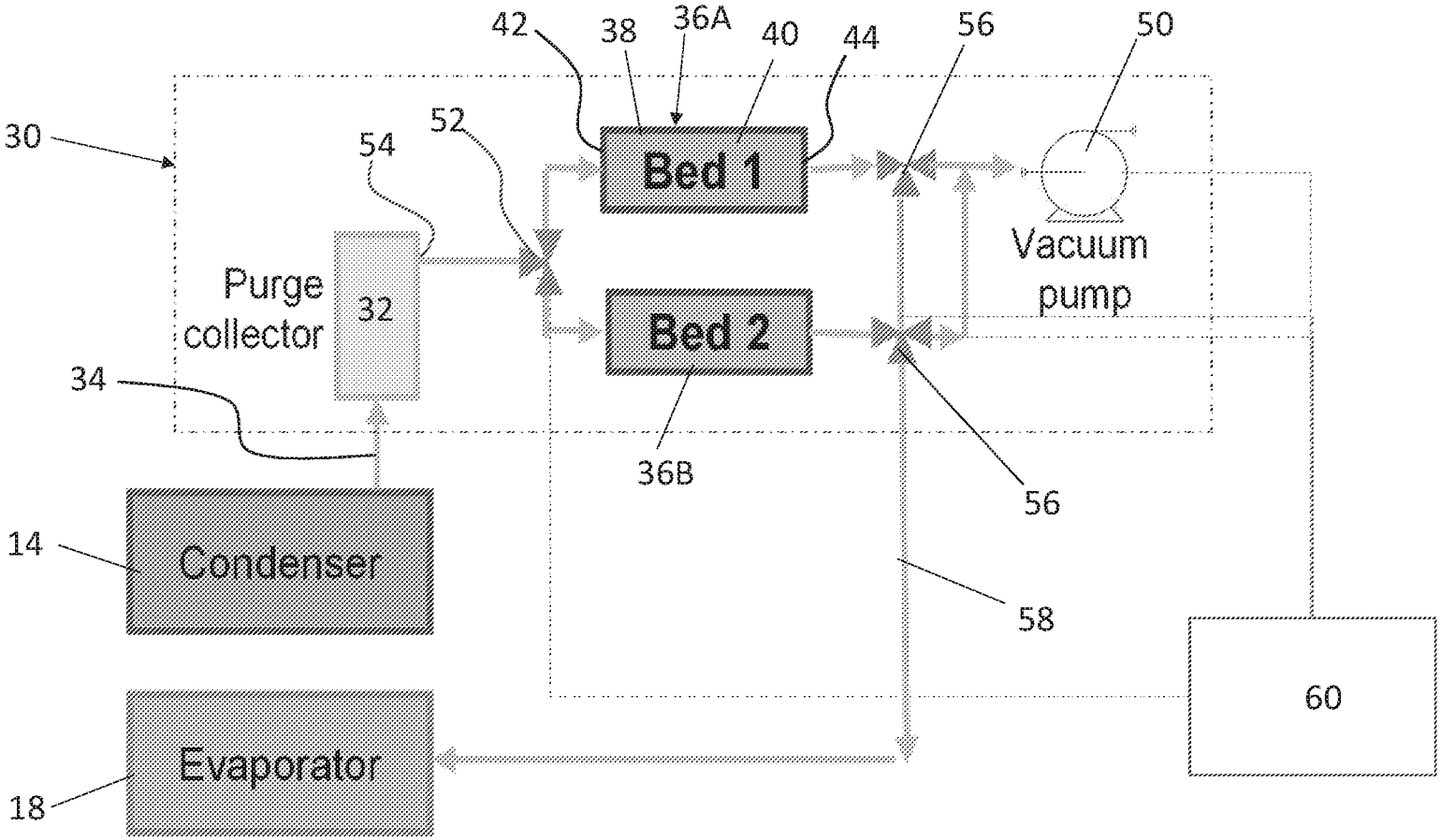
FIG. 2 is a schematic diagram of a purge system according to an embodiment.

With reference now to FIG. 2, an example of a purge system 30 is illustrated in more detail. As shown, the purge system 30 includes a purge collector 32 connected to the condenser 14 of a vapor compression loop 10 via a purge connection 34. The purge collector 32 receives purge gas including refrigerant gas and contaminants, such as nitrogen and oxygen for example, from the purge connection 34. The purge system 30 additionally includes at least one separator 36 arranged downstream from and in fluid communication with the purge collector 32. In the illustrated, non-limiting embodiment, the purge system 30 includes a first separator 36 and a second separator 36 arranged in parallel. However, it should be understood that any number of separators 36, such as three or more separators for example, may be arranged downstream from the purge collector 32. In an embodiment, each separator 36 includes a vessel 38 containing a bed of sorbent material 40 operable to separate a non-condensable gas from the purge gas through pressure swing sorption (PSA). It should be understood that each separator 36 may include a single bed of sorbent material 40, or alternatively, multiple beds of sorbent material.

The sorbent material 40 may be a porous inorganic material. Examples of suitable sorbent materials include, but are not limited to, zeolites, activated carbon, ionic liquids, metal organic framework, oils, clay materials, and molecular sieves for example. When the bed of sorbent material 40 is pressurized to a high, adsorption pressure, the more readily adsorbable component of the purge gas provided to the inlet end 42 of the separator 36 is selectively adsorbed by the sorbent material 40 and forms an adsorption front that passes from the inlet end 42 toward the outlet end 44. The less readily adsorbable component of the purge gas passes through the bed of sorbent material 40 and is recovered from the outlet end 44 thereof for further processing or use downstream. In the illustrated, non-limiting embodiment, the contaminant within the purge gas, such as oxygen for example, is the more readily adsorbable component, and the refrigerant is the less adsorbable component within the purge gas. Accordingly, if the purge gas is passed through a vessel 38 containing a bed of sorbent material 40 that attracts oxygen, part or all of the oxygen in the purge gas will stay within the bed of sorbent material 40. Consequently, the purge gas discharged from the outlet end 44 of the vessel 38 will be richer in refrigerant than the purge gas entering the vessel 38.

When the bed of sorbent material 40 reaches the end of its capacity to adsorb oxygen, the bed of sorbent material 40 can be regenerated by reducing the pressure acting thereon. By reducing the pressure, the adsorbed oxygen will be released from the bed of sorbent material 40, and may be exhausted from the separator 36, such as to the ambient atmosphere, external to the refrigeration circuit. However, it should be understood that in other embodiments, the bed of sorbent material may be regenerated via application of either a positive or negative pressure.

In some embodiments, pore sizes can be characterized by a pore size distribution with an average pore size from 2.5 Å to 10.0 Å, and a pore size distribution of at least 0.1 Å. In some embodiments, the average pore size for the porous material can be in a range with a lower end of 2.5 Å to 4.0 Å and an upper end of 2.6 Å to 10.0 Å. In some embodiments, the average pore size can be in a range having a lower end of 2.5 Å, 3.0 Å, 3.5 Å, and an upper end of 3.5 Å, 5.0 Å, or 6.0 Å. These range endpoints can be independently combined to form a number of different ranges, and all ranges for each possible combination of range endpoints are hereby disclosed. Porosity of the material can be in a range having a lower end of 5%, 10%, or 15%, and an upper end of 85%, 90%, or 95% (percentages by volume). These range endpoints can be independently combined to form a number of different ranges, and all ranges for each possible combination of range endpoints are hereby disclosed.

In some embodiments, the microporous material can be configured as nanoplatelets, such as zeolite nanosheets for example. Zeolite nanosheet particles can have thicknesses ranging from 2 to 50 nm, more specifically 2 to 20 nm, and even more specifically from 2 nm to 10 nm. Zeolite such as zeolite nanosheets can be formed from any of various zeolite structures, including but not limited to framework type MFI, MWW, FER, LTA, CHA, FAU, and mixtures of the preceding with each other or with other zeolite structures. In a more specific group of exemplary embodiments, the zeolite such as zeolite nanosheets can comprise zeolite structures selected from MFI, MWW, FER, LTA, CHA framework type. Zeolite nanosheets can be prepared using known techniques such as exfoliation of zeolite crystal structure precursors. For example, MFI and MWW zeolite nanosheets can be prepared by sonicating the layered precursors (multilamellar silicalite-1 and ITQ-1, respectively) in solvent. Prior to sonication, the zeolite layers can optionally be swollen, for example with a combination of base and surfactant, and/or melt-blending with polystyrene. The zeolite layered precursors are typically prepared using conventional techniques for preparation of microporous materials such as sol-gel methods.

Figure 3:
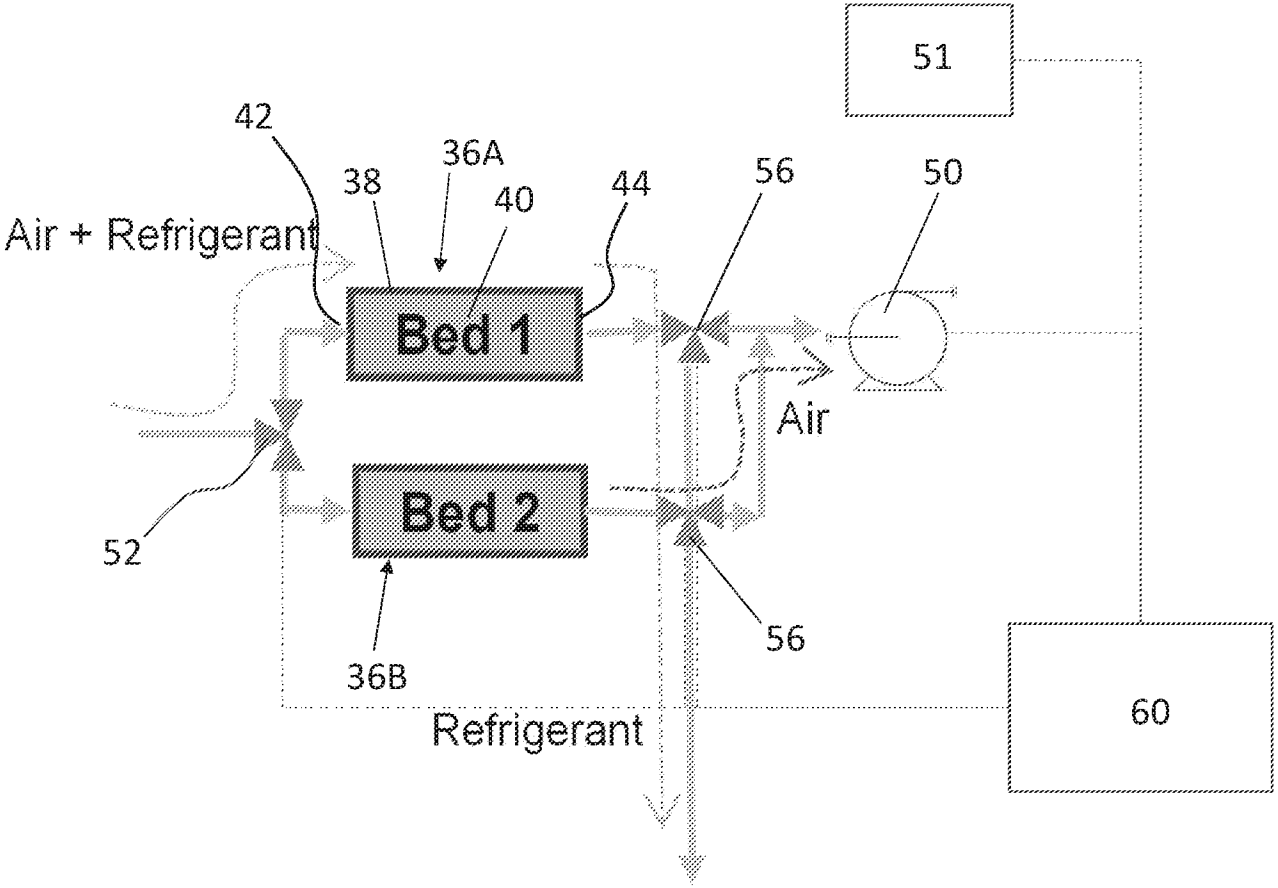
FIG. 3 is a schematic diagram of a portion of a purge system during operation in a first stage according to an embodiment.

A prime mover 50, such as a vacuum pump or compressor for example, may be selectively coupled to each of the plurality of separators 36. The prime mover 50 may be used to alter the pressure within the separators 36 and thereby control the sorption performed by the bed of sorbent material 40. Alternatively, or in addition, heat, such as generated by a heat source 51, may be used to control the sorption performed by the bed of sorbent material 40 (see FIG. 3). For example, heat may be used as either a driving force for either sorption or regeneration of the sorbent material 40. In such embodiments, the heat source 51 may be located within the separator 36, or alternatively may be located remotely from but in thermal communication with the sorbent material 40 of the separator 36. In the illustrated, non-limiting embodiment, a first valve 52 is arranged between the outlet 54 of the purge collector 32 and the inlet end 42 of each of the plurality of separators 36 of the purge system 30. The first valve 52 is operable to control a flow of purge gas to all or only a portion of the plurality of separators 36.

A valve 56 may similarly be arranged adjacent the outlet end 44 of each of the plurality of separators 36. The valve 56 is arranged at an interface between the outlet end 44 of the separator 36 and a conduit 58 for returning the refrigerant rich purge gas to the refrigerant fluid circulation loop, and specifically to the chiller or evaporator 18. In an embodiment, the valves 56 is operable to selectively connect the separator 36 to the prime mover 50 and the conduit 58.

A controller 60 is operably coupled to the prime mover 50 and the plurality of valves 52, 56 of the purge system 30. In an embodiment, the controller 60 receives system data (e.g., pressure, temperature, mass flow rates) and operates one or more components of the purge system 30 in response to the system data.

In an embodiment, the purge gas is provided to the plurality of separators 36 of the purge system 30 simultaneously. Alternatively, the purge gas may be provided to different separators 36 during different stages of operation, thereby allowing for continuous operation of the purge system 30. For example, with reference to FIG. 3, a first stage of operation of the purge system 30 is illustrated. As shown, during the first stage of operation, the valve 52 is positioned to direct a flow of purge gas from the purge collector to only the first separator 36. The valve 56 arranged at the outlet end 44 of the first separator 36A is configured such that the prime mover is in communication with the first separator 36A. Accordingly, operation of the prime mover 50 increases the pressure acting on the bed of sorbent material 40 within the first separator 36. As the purge gas is provided to the first separator 36A, contaminants within the purge gas, such as oxygen or air for example, are adsorbed by the bed of sorbent material 40, and the refrigerant passes through the bed of sorbent material 40. The refrigerant rich purge gas output from the first separator 36A is then returned to the refrigeration circuit via conduit 58. During this first stage of operation, the second separator 36B is at atmospheric pressure. As a result, any contaminants or air previously adsorbed by the bed of sorbent material 40 therein is released. The valve 56 arranged at the outlet end 44 of the second separator 36B is positioned to direct the flow of contaminants toward the prime mover 50 to be exhausted externally from the purge system 30.

Once the bed of sorbent material 40 within the first separator 36A becomes saturated, the controller 60 will transform the purge system 30 to a second stage of operation by adjusting the position of upstream valve 52, and downstream valves 56. In an embodiment, the controller 60 is configured to transition between various stages of operation in response to a purge signal. The purge signal can be generated from various criteria. In some embodiments, the purge signal can be in response to elapse of a predetermined amount of time (e.g., simple passage of time, or tracked operating hours) tracked by controller circuitry. In some embodiments, the purge signal can be generated in response to human operator input. In some embodiments, the purge signal can be in response to measured parameters of the refrigerant fluid flow loop, such as a pressure sensor.

Figure 4:
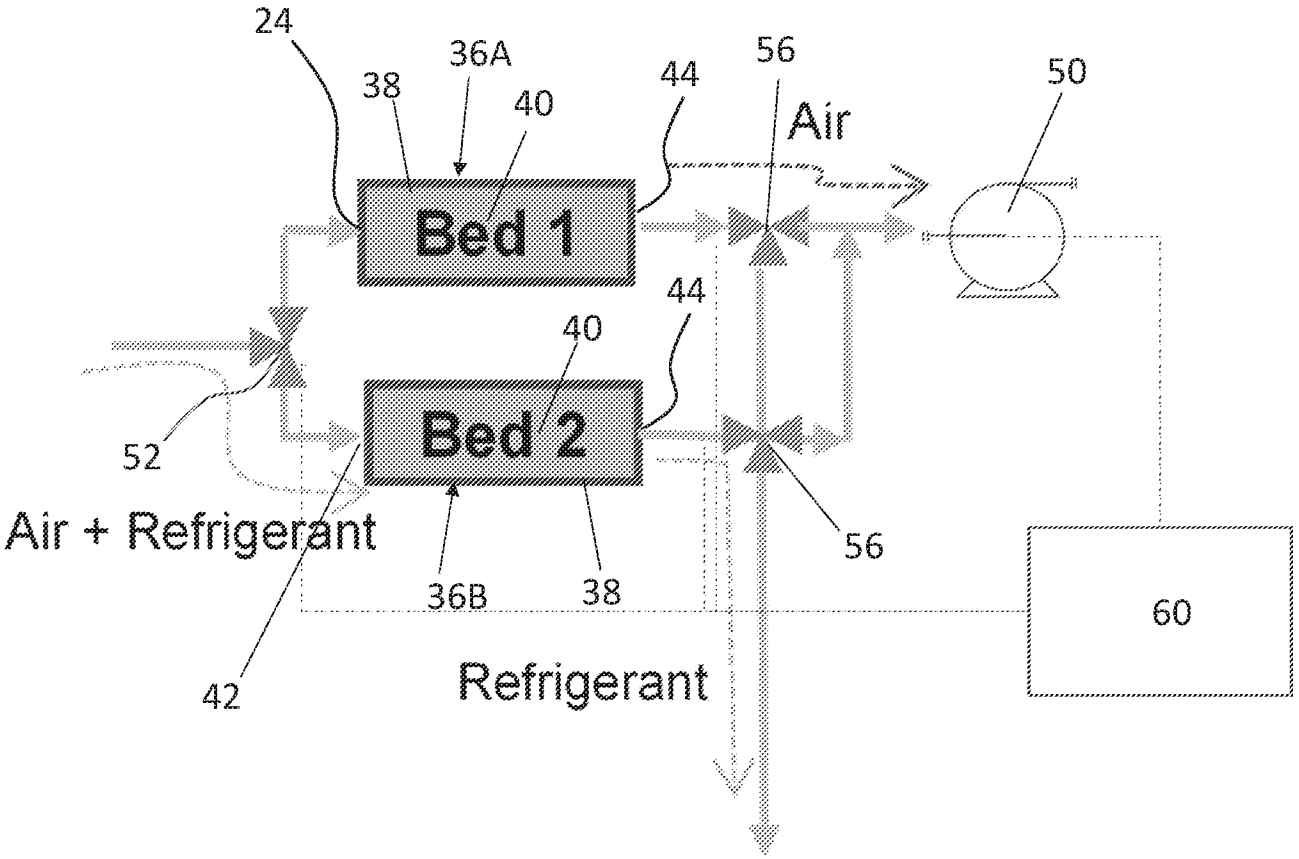
FIG. 4 is a schematic diagram of a portion of a purge system during operation in a second stage according to an embodiment.

In the second stage of operation, best shown in FIG. 4, valve 52 is configured to direct the entire flow of purge gas output from the purge collector 32 towards the second separator 36B. Within the second separator 36B, contaminants within the purge gas, such as oxygen or air for example, are adsorbed by the bed of sorbent material 40, and the refrigerant passes through the bed of sorbent material 40. The refrigerant rich purge gas output from the second separator 36B is then returned to the refrigeration circuit via conduit 58. During this second stage of operation, the first separator 36A regenerates by releasing the contaminants and/or air previously adsorbed therein. Once the bed of sorbent material 40 within the second separator 36B becomes saturated, the controller 60 will transform the purge system 30 back to the first stage of operation, during which the second separator may regenerate.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigeration system comprising:

a vapor compression loop;

a purge system in communication with the vapor compression loop, the purge system including at least one separator including a sorbent material to separate contaminants from a refrigerant purge gas provided from the vapor compression loop when a driving force is applied to the sorbent material;

a heat source in thermal communication with the sorbent material of the at least one separator, the heat source being located remotely from the separator and in thermal communication with the sorbent material.

2. The refrigeration system of claim 1, further comprising a prime mover selectively coupled to the at least one separator to apply the driving force to the sorbent material.

3. The refrigeration system of claim 2, wherein the prime mover is a vacuum pump.

4. The refrigeration system of claim 1, wherein the at least one separator is arranged in fluid communication with the vapor compression loop.

5. The refrigeration system of claim 4, wherein the vapor compression loop comprises a compressor, a heat rejection heat exchanger, an expansion device, and a heat absorption heat exchanger connected by a conduit.

6. The refrigeration system of claim 5, wherein refrigerant passing through the sorbent material is returned to the at least one of the heat rejection heat exchanger and the heat absorption heat exchanger.

7. The refrigeration system of claim 5, wherein the purge system further comprises a purge gas collector in communication with the at least one separator and at least one of the heat rejection heat exchanger and the heat absorption heat exchanger.

8. The refrigeration system of claim 2, wherein said at least one separator includes a first separator and a second separator arranged in parallel.

9. The refrigeration system of claim 8, further comprising a flow control valve arranged upstream from an inlet end of both the first separator and the second separator, the flow control valve being selectively controllable to direct a flow toward one of the first separator and the second separator.

10. The refrigeration system of claim 8, further comprising a first valve arranged downstream from an outlet end of the first separator, wherein the first valve is movable between a first position and a second position.

11. The refrigeration system of claim 10, wherein when the first valve is in the first position, the prime mover is connected to the first separator and the outlet end of the first separator is in fluid communication with the vapor compression loop.

12. The refrigeration system of claim 9, further comprising a controller operably coupled to the flow control valve and to the prime mover.

13. The refrigeration system of claim 1, wherein the sorbent material of the at least one separator is arranged in a bed.

14. The refrigeration system of claim 1, wherein the sorbent material of the at least one separator is arranged in a plurality of beds.

15. The refrigeration system of claim 1, wherein the heat source is operable to generate the driving force applied to the sorbent material.

16. A method of operating a refrigeration system comprising:

circulating a refrigerant through a vapor compression loop including a compressor, a heat rejecting heat exchanger, an expansion device, and a heat absorbing heat exchanger;

collecting purge gas comprising contaminants from the vapor compression loop; and providing the purge gas to a separator pressurized by a prime mover to allow passage of refrigerant through a sorbent material and sorption of contaminants within the separator; and heating the sorbent material within the separator via a heat source located remotely from the separator.

17. The method of claim 16, further comprising collecting the purge gas in a purge gas collector positioned between the vapor compression loop and the separator.

18. The method of claim 17, further comprising returning refrigerant that has passed through the sorbent material to the vapor compression loop.

19. The method of claim 17, further comprising adjusting a pressure of the separator to regenerate the sorbent material.

* * * * *